United States Patent [19]

Penttilä

[11] Patent Number: 4,556,166

[45] Date of Patent: Dec. 3, 1985

[54] LIQUID-TIGHT CARDBOARD BARREL AND METHOD AND DEVICE FOR MANUFACTURING SAID BARREL

[76] Inventor: Pertti Penttilä, Hämeenpuisto 42 A 20, 33200 Tampere 20, Finland

[21] Appl. No.: 557,155

[22] PCT Filed: Feb. 17, 1983

[86] PCT No.: PCT/F183/00014

§ 371 Date: Oct. 26, 1983

§ 102(e) Date: Oct. 26, 1983

[87] PCT Pub. No.: WO83/02929

PCT Pub. Date: Sep. 1, 1983

[30] Foreign Application Priority Data

Feb. 26, 1982 [FI] Finland ..... 820692

[51] Int. Cl.[4] ..... B65D 5/40

[52] U.S. Cl. ..... 229/3.1; 229/4.5; 229/5.5; 220/457; 220/458

[58] Field of Search ..... 229/1.5 B, 4.5, 5.5, 229/5.1; 220/450, 457, 458, 67

[56] References Cited

U.S. PATENT DOCUMENTS

| | | | |
|---|---|---|---|
| 1,057,426 | 4/1913 | Heyl | 229/1.5 B |
| 1,798,339 | 3/1931 | Soulis | 229/1.5 B |
| 2,266,828 | 12/1941 | Sykes | 229/1.5 B |
| 3,988,521 | 10/1976 | Fumel et al. | 229/1.5 B |
| 4,016,327 | 4/1977 | Fumel et al. | 229/1.5 B |
| 4,061,782 | 12/1977 | Baxter | 229/1.5 B |
| 4,117,971 | 10/1978 | Itoh | 229/1.5 B |
| 4,211,339 | 7/1980 | Itoh | 229/1.5 B |

*Primary Examiner*—Joseph Man-Fu Moy

*Attorney, Agent, or Firm*—Phillips, Moore, Lempio & Finley

[57] ABSTRACT

The present invention relates to a liquid-tight cardboard barrel and a method and a device for manufacturing said barrel. The wall portion (1) of the barrel is provided with an inner plastic coating making the wall liquid-tight. In order to ensure liquid-tightness of the barrel, a plastic film disc (4), which is somewhat larger than the cross-sectional area of the barrel, is disposed on the bottom of the barrel so that its edge (6) is positioned against the inner surface of the wall of the barrel, whereafter the edge is welded to the coating (3) of the wall portion but is left loose with respect to the bottom plate (2).

8 Claims, 4 Drawing Figures

LIQUID-TIGHT CARDBOARD BARREL AND METHOD AND DEVICE FOR MANUFACTURING SAID BARREL

TECHNICAL FIELD

The present invention relates to a liquid-tight cardboard barrel having a plastic film on the inner surface of the wall portion and bottom plate, whereby the plastic film on the wall portion forms a coating fastened substantially over the entire area of said wall portion. The invention also relates to a method and a device for manufacturing such a cardboard barrel.

BACKGROUND ART

A plurality of methods are previously known for making a cardboard barrel liquid-tight. One method is to provide the inner surface of the wall and bottom plate of the barrel with a plastic coating before joining the bottom plate to the wall portion. The bottom plate is hereafter mechanically joined to the cylindrical wall portion. This solutions suffers from the disadvantage of an unreliable liquid-tightness at the joint between the bottom plate and the wall because if the barrel during transport is subjected to bumps, a slit may be formed in the joint through which liquid is able to flow out of the barrel. The strength of the joint can be improved by welding the coatings the each other at the joint but because the thin plastic film is easily torn in connection with the deformation of the joint, is this sealing method neither very reliable. In this connection it is also to be noted that the upper and lower edge of the barrel are in general mostly subjected to bumps.

In addition to the above described barrel, barrels are known inside which a plastic bag is arranged which is secured to the barrel at its mouth only. The liquid-tightness of such a barrel in general remains satisfactory inspite of bumps because the deformations of the barrel do not directly affect the bag. However, barrels provided with a loose inner bag suffer from a plurality of disadvantages, wherefore they are not very commonly used. They are particularly difficult to fill and empty.

DISCLOSURE OF INVENTION

The object of the present invention is to provide a liquid-tight cardboard barrel, which is not sensitive to bumps. The cardboard barrel according to the invention is characterized in that the plastic film located at the bottom plate and abutting against it is loose with respect to the bottom plate and joins the plastic coating of the wall portion. Because the plastic film at the bottom plate is loose with respect to said plate, deformations at the lower edge of the barrel and relative movements between the wall and the bottom do not directly affect the sealing film, which thus in all likelihood will remain intact when the barrel is subjected to bumps. However, because the sealing plastic film is fastened to the wall of the barrel, the same problems do not arise in use of the barrel as in connection with barrels comprising a loose inner bag. In addition, it is to be noted that the connection point between the loose plastic film and the wall coating can be located inside the junction between the wall portion and the bottom plate at a short distance from said junction, due to which the tendency of the film to break is further reduced.

The invention also relates to a method for manufacturing a liquid-tight cardboard barrel, according to which method the inner surface of the wall portion and the bottom plate of the barrel is provided with a continuous plastic film. The method according to the invention is characterized in that, in order to provide the inner surface of the bottom plate with the plastic film, a plastic film disc having a diameter somewhat larger than the inner diameter of the barrel is pressed against the inner surface of the bottom plate, whereafter the edge of the disc is secured to the plastic coating of the wall portion of the barrel by welding. In a cardboard barrel so manufactured the film does not extend to the joint between the wall and the bottom plate, which is easily subjected to bumps, so that deformations of the lower edge of the barrel are not able to break it. The strength of the liquid-tight film is improved by the fact that the plastic film disc is not secured to the inner surface of the bottom plate so that the liquid-tight film corresponds, as far as the barrel bottom is concerned, to a loose inner bag the tightness of which does not suffer from deformations of the bottom. According to the invention, a liquid-tight joint is obtained between the inner coating of the barrel wall and the creased edge of the plastic film disc by welding the plastic parts to each other, for example, by means of high-frequency radio wave radiation.

In order to position the plastic film disc evenly against the bottom plate, the plastic film disc is preferably pressed against the bottom plate with a planar plunger which is somewhat smaller in diameter than the bottom plate.

The invention also relates to a device for manufacturing a liquid-tight cardboard barrel in which a continuous plastic film is provided on the surface of the wall and the bottom plate. The device according to the invention is characterized in that the device comprises a plunger for pressing a plastic film disc of somewhat larger diameter than the inner diameter of the barrel against the bottom plate, and welding means for securing the edge of the disc disposed against the wall of the barrel to the plastic coating of the wall.

BRIEF DESCRIPTION OF THE DRAWINGS

One preferred embodiment of the invention will be described in more detail in the following with reference to the accompanying drawing, in which.

BEST MODE OF CARRYING OUT THE INVENTION

Figure 1:
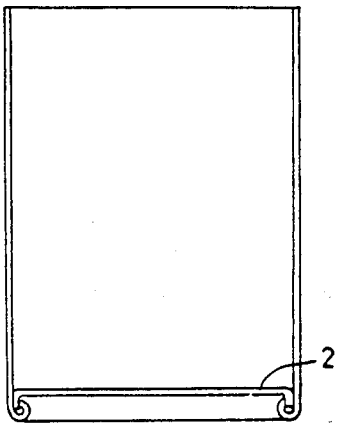
FIG. 1 is a schematical longitudinal section of a cardboard barrel.
Figure 4:
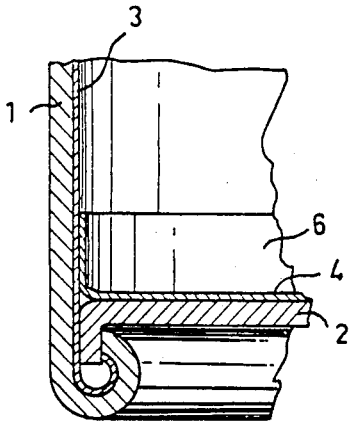
FIG. 4 shows on an enlarged scale one part of a barrel manufactured by means of the method according to the invention.

FIG. 1 shows a barrel made of cardboard, a so-called fibre barrel, in which to one end of a cylindrical wall portion 1 is secured a circular bottom plate 2. Instead of cardboard, the bottom plate can be made of, for example, plastic or metal. In the embodiment shown in the Figure, the wall portion and the bottom plate are joined to each other so that the edge of the bottom plate is bent downwards and the edge of the wall portion is bent around the edge of the bottom plate. Also other conventional joining methods are conceivable. To the inner surface of the wall portion 1 of the barrel is applied a coating 3 (FIG. 4) of plastic, for example, polyvinyl chloride or polyethylene, which is secured to the wall portion by means of any conventional technique. Thus, the barrel is made liquid-tight as far as the wall is concerned before starting the method according to the invention.

Figure 2:
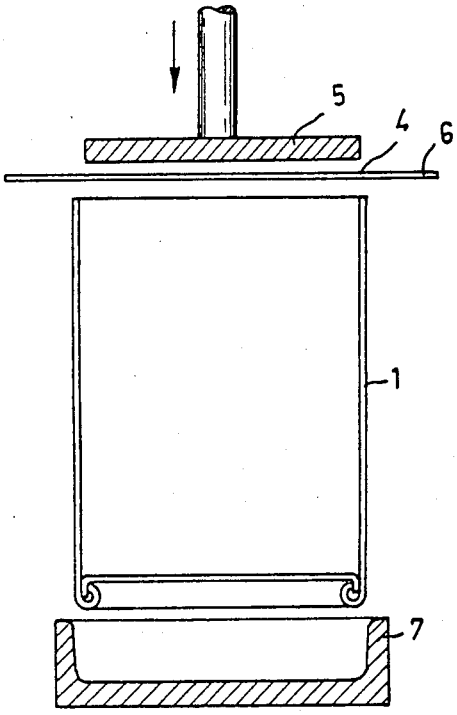
FIG. 2 illustrates the situation before forcing the plastic film disc to the bottom of the barrel.

FIG. 2 illustrates schematically how a circular plastic disc 4 having a diameter somewhat larger than the inner diameter of the barrel is positioned at the open end of the barrel and pressed into the barrel down to the bottom by means of a plunger 5. The plunger has a planar underside, due to which the plastic film disc will be evenly disposed against the inner surface of the bottom plate. Because the disc 4 which is preferably of thin, flexible PVC is larger than the cross-sectional area of the barrel, the edge of the disc will be positioned in the vertical position shown by FIGS. 3 and 4 against the inner surface of the barrel wall. The plunger 5 is so thick in the vertical direction that its edge keeps the edge 6 of the plastic film disc in this position. As the edge 6 of the disc is bent into the vertical position, it is curtailed so that it is partly pressed against the wall of the barrel and partly against the edge of the plunger.

Figure 3:
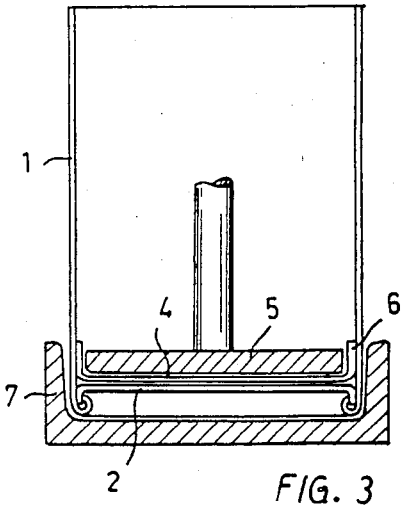
FIG. 3 illustrates the welding step.

When the plastic film disc 4 is positioned in place according to FIG. 3, its edge 6 is welded to the coating 3 of the wall portion of the barrel. For this purpose, the lower end of the barrel is surrounded by an outer welding electrode 7, while an inner electrode is arranged in the plunger 5. In order that the edge 6 of the disc, inspite of its creases, should be tightly secured to the coating 3, the electrode 7 is made in the shape of a hoop the diameter of which is adjustable so that the wall of the barrel, by means of it, can be somewhat compressed in order to clamp the edge 6 of the disc between the coating 3 and the edge of the plunger 5. The welding is carried out by means of radio waves having a frequency of about 20 to 30 MHz. This welding method causes no changes in the cardboard of the wall portion 1.

It appears from the foregoing that the plastic film disc does not adhere to the bottom plate 2. As a result, no stresses are applied on the plastic film disc even though the wall portion and the bottom plate would be displaced with respect to each other, for example, due to a blow applied on the barrel during transport. Thus, the barrel remains liquid-tight also in the event that its lower edge would be considerably deformed.

The liquid-tight barrel according to the invention can be also produced by fastening a plastic bag of a suitable size to the wall portion of the barrel but by leaving it loose at the bottom plate. In addition, it is obvious that the barrel can have another cross-sectional shape than circular, for example, square. The tightening hoop can be dispensed with if an expanding plunger is used.

Instead of the whole hoop 7, a part of the hoop or a wheel rotating around the outer periphery of the barrel cam be used as outer electrode.

I claim:

1. A liquid-tight barrel comprising
an upstanding tubular wall having an open upper end and a lower end,
a bottom plate secured to the lower end of said wall to form a closed bottom end on said barrel,
first means for forming an impervious liquid barrier internally on the inner surfaces of said wall, and
second means for forming an impervious liquid barrier internally of the bottom end of said barrel, including an outer portion secured directly to said first means at the lower end of said wall to form a liquid-tight seal therewith and a flexible bottom portion closely overlying said bottom plate in unsecured relationship therewith to maintain said bottom portion and said seal substantially stress-free when said barrel is subjected to forces of deformation.

2. The barrel of claim 1 wherein said wall is cylindrical and said second means is annular and cup shaped.

3. The barrel of claim 2 wherein said flat means comprises a plastic coating bonded to the inner surface of said wall and said second means comprising a separate circular flexible plastic disc deformed to have the outer portion thereof bonded to said plastic coating to form said liquid tight seal.

4. The barrel of claim 3 wherein each of said plastic coating and said plastic disc comprises polyvinyl chloride or polyethylene.

5. The barrel of claim 3 wherein said wall is composed of a cardboard material and said bottom plate is composed of a cardboard, plastic or metallic material.

6. The barrel of claim 3 wherein an outer edge of said bottom plate is bent downwardly to define an annular flange and a lower edge of said wall is bent inwardly and upwardly around said flange, said plastic coating bonded entirely along the inner surface of said wall, including the lower edge thereof.

7. The barrel of claim 3 wherein the outer portion of said disc is annular and is solely bonded to annular portions of the inner surfaces of said wall located closely adjacent to said bottom plate, internally of said barrel.

8. The barrel of claim 3 wherein an inner surface of said bottom plate and a bottom portion of said disc are each flat.

* * * * *

UNITED STATES PATENT AND TRADEMARK OFFICE

CERTIFICATE OF CORRECTION

PATENT NO. : 4,556,166

DATED : December 3, 1985

INVENTOR(S) : Pertti Penttila

It is certified that error appears in the above-identified patent and that said Letters Patent is hereby corrected as shown below:

Col. 1, line 21, change "solutions" to --solution--.

Col. 4, line 5, change "cam" to --can--.

Col. 4, line 26 (claim 3, line 1) change "flat" to --first--.

Col. 4, line 28 (claim 3, line 3) change "comprising" to --comprises--.

Signed and Sealed this

*Third* Day of *June 1986*

[SEAL]

*Attest:*

DONALD J. QUIGG

*Attesting Officer*

*Commissioner of Patents and Trademarks*